US009761952B2

(12) United States Patent
Peng

(10) Patent No.: US 9,761,952 B2
(45) Date of Patent: Sep. 12, 2017

(54) BROADBAND NOTCH ANTENNAS

(71) Applicant: WavCatcher, Dallas, TX (US)

(72) Inventor: Sheng Yeng Peng, Lynnwood, WA (US)

(73) Assignee: WavCatcher, Dallas, TX (US)

( * ) Notice: Subject to any disclaimer, the term of this patent is extended or adjusted under 35 U.S.C. 154(b) by 0 days.

(21) Appl. No.: 15/333,540

(22) Filed: Oct. 25, 2016

(65) Prior Publication Data

US 2017/0047659 A1 Feb. 16, 2017

Related U.S. Application Data

(62) Division of application No. 14/224,642, filed on Mar. 25, 2014.

(60) Provisional application No. 61/804,931, filed on Mar. 25, 2013.

(51) Int. Cl.
*H01Q 13/08* (2006.01)
*H01Q 5/335* (2015.01)

(52) U.S. Cl.
CPC ..... *H01Q 13/085* (2013.01); *H01Q 5/335* (2015.01)

(58) Field of Classification Search
None
See application file for complete search history.

(56) References Cited

FOREIGN PATENT DOCUMENTS

GB 2281662 A * 9/1994

* cited by examiner

*Primary Examiner* — Robert Karacsony
(74) *Attorney, Agent, or Firm* — Olympic Patent Works PLLC

(57) ABSTRACT

This disclosure is directed to broadband notch antennas. In one aspect, a notch antenna includes a dielectric plate having a first surface and a second surface located opposite the first surface. A conductive layer is disposed on the first surface and has a notch region that exposes the dielectric plate between edges of the conductive layer. The antenna also includes two or more frequency matching circuits that branch from the notch region. Each matching circuit is configured to send and receive electromagnetic radiation in a frequency band of a radio spectrum.

8 Claims, 9 Drawing Sheets

BROADBAND NOTCH ANTENNAS

CROSS-REFERENCE TO RELATED APPLICATIONS

This application is a divisional of patent application Ser. No. 14/224,642, filed Mar. 25, 2014, which claims the benefit of Provisional Application No. 61/804,931, filed Mar. 25, 2013.

TECHNICAL FIELD

The present disclosure is directed to antennas, and, in particular, to broadband and ultra-broadband antennas.

BACKGROUND

In recent years, the rapid development of a wide variety of wireless-communication devices has brought about a wave of new antenna technologies. Mobile phones and wireless networks are just a few examples of wireless, multiple frequency, and multi-mode devices that have driven the advancement of antenna technology. Antennas used in current and future wireless-communication devices are expected to have high gain, small physical size, broad bandwidth, versatility, low manufacturing cost, and are capable of embedded installation. These antennas are also expected to satisfy performance requirements over particular operating frequency ranges. For example, fixed-device antennas, such as cellular base-stations and wireless access points, should have high gain and stable radiation coverage over a selected operating frequency range. On the other hand, antennas for mobile wireless devices, such as mobile phones, tablets, and laptop computers, should be efficient in radiation and omni-directional coverage. These antennas are expected to provide impedance matching over selected operating frequency ranges.

However, many antennas that are currently used in wireless-communication devices satisfy the embedded installation and low cost manufacturing requirements but have limited bandwidths. Researchers and engineers in the wireless-communications industry seek antennas that are low cost and capable of embedded installation, but are also able to receive and transmit over broad bandwidths for multiple frequency or multi-mode wireless communication devices and systems.

SUMMARY

This disclosure is directed to broadband notch antennas. In one aspect, a notch antenna includes a dielectric plate having a first surface and a second surface located opposite the first surface. A conductive layer is disposed on the first surface and has a notch region that exposes the dielectric plate between edges of the conductive layer. The antenna also includes two or more frequency matching circuits that branch from the notch region. Each matching circuit is configured to send and receive electromagnetic radiation in a broadband or ultra-broadband frequency band of the radio spectrum.

DETAILED DESCRIPTION

Figure 1A:
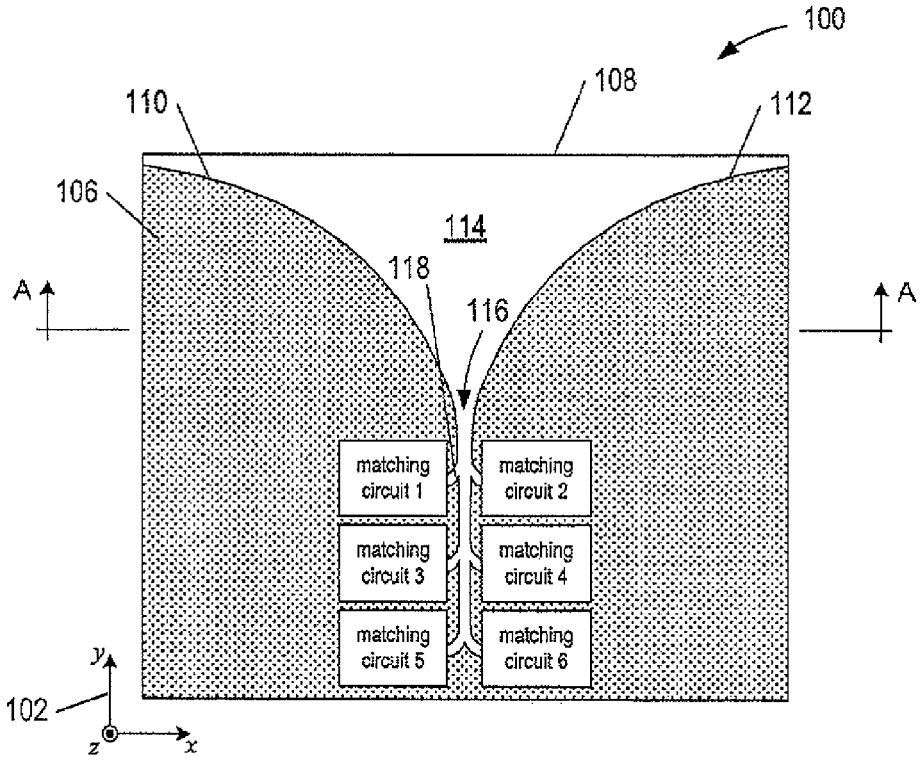
FIGS. 1A and 1B show a plan view and a cross-sectional view, respectively, of an example broadband notch antenna.
Figure 1B:
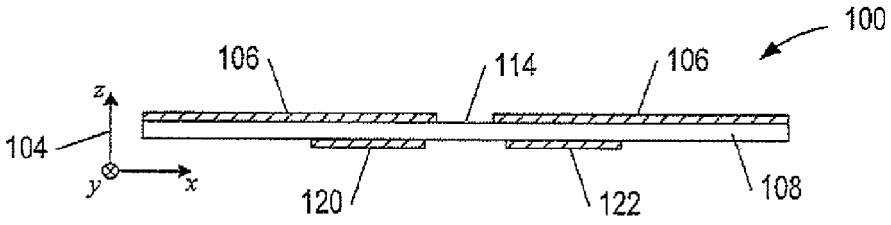

FIGS. 1A and 1B show a plan view and a cross-sectional view, respectively, of an example broadband notch antenna 100. FIG. 1A includes an xy-plane 102 and FIG. 1B includes an xz-plane 104 of the same Cartesian coordinate system having three orthogonal spatial axes labeled x, y and z. The coordinate system is used to specify orientations of the antenna 100. In FIG. 1A, the antenna 100 lies in the xy-plane 102 and includes a thin conductive layer 106, represented by shading, disposed on a first surface of a dielectric plate 108. FIG. 1B shows a cross-sectional view of the antenna 100 along a line A-A shown in FIG. 1A. In FIG. 1A, the conductive layer 106 includes a horn-shaped or trumpet-shaped notched region 114 that exposes the first surface between two curved edges 110 and 112 of the layer 106. The notched region 114 between the curved edges 110 and 112 is called an "antenna aperture" that tapers to form a central channel 116 called the "throat." In this particular example, the throat 116 includes six channels that branch to six separate frequency matching circuits referred to as matching circuits 1-6. For example, channel 118 branches from the throat 116 to the matching circuit 1. The throat 116 funnels electromagnetic radiation resonating in the antenna aperture 114 into the matching circuits and channels electromagnetic radiation generated in the matching circuits into the antenna aperture 114. As described in greater detail below, each matching circuit is formed in the conductive layer 106 and includes electronic devices disposed on a second surface of the dielectric plate 108 opposite the first surface. For example, as shown in FIG. 1B, conductive regions 120 and 122 are conductive materials disposed on the second surface of the dielectric plate 108 to form two of the matching circuits.

It should be noted that broadband antennas are not intended to be limited to six matching circuits. Broadband antennas may be configured with any number of matching circuits to interact with different frequency bands of the radio spectrum of the electromagnetic spectrum. In particular, broadband antennas may be configured with M matching circuits, where M is a positive integer greater than or equal to two. Other broadband antennas with two or more matching circuits may be configured analogous to the broadband antenna 100 with the two or more matching circuits branching from a throat of an antenna aperture.

The dielectric plate 108 may be composed of a rigid or flexible dielectric material including, but not limited to, fiberglass, polyester film such as polyethylene terephthalate, polyimide, plastic, wood, or paper. The thickness of the dielectric plate 108 may range from about 2 millimeters to about 10 millimeters or a suitable thickness greater than 10 millimeters. The conductive layer 106 and conductive regions of the matching circuits may be composed of any electrically conductive material including, but not limited to, aluminum, copper, silver, gold, or platinum. The thickness of the conductive layer 106 may range from about 0.5 millimeters to about 2 millimeters. The conductive layer 106 and conductive regions may be deposited and formed using any one or many different methods for depositing and etching conductive materials.

Figure 2:
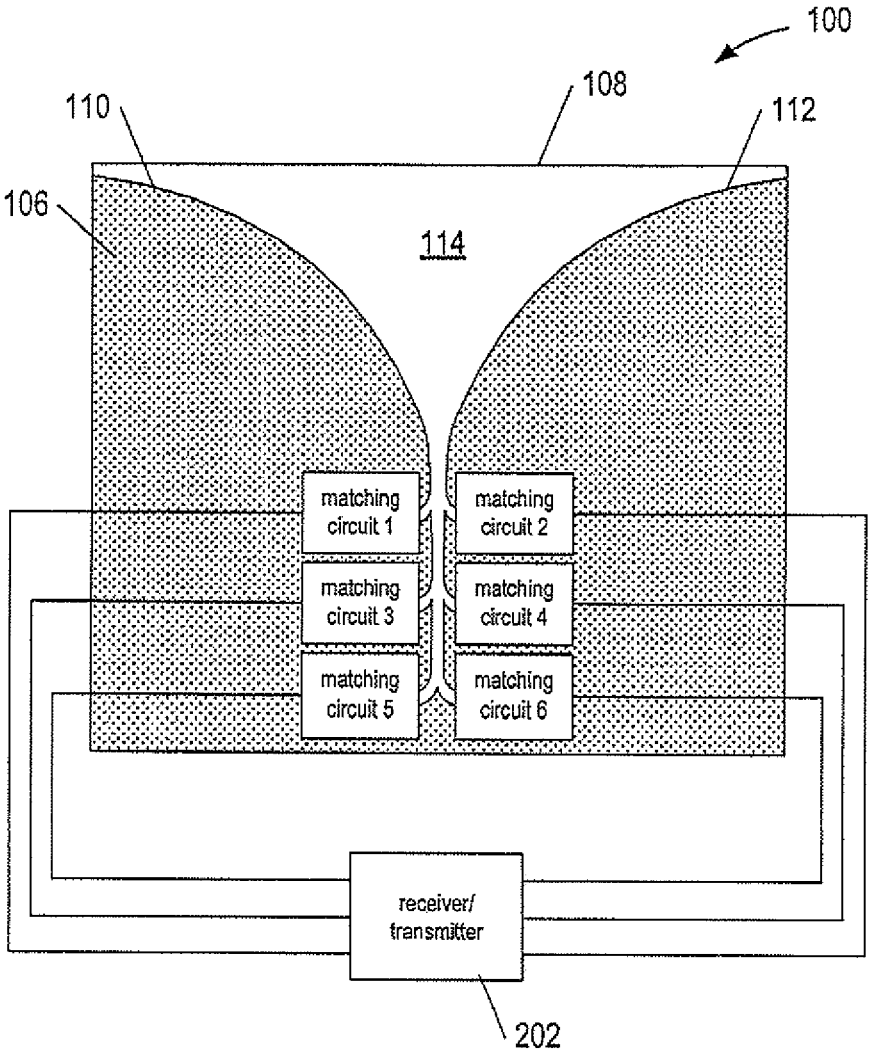
FIG. 2 shows six matching circuits of the broadband antenna shown in FIG. 1A connected to a receiver/transmitter.

The antenna aperture 114 and matching circuits 1-6 may be used to receive and transmit electromagnetic radiation over a broadband of frequencies in the radio spectrum. FIG. 2 shows the matching circuits 1-6 connected to a receiver/transmitter 202. Each matching circuit is configured as described below to convert electromagnetic radiation that interacts with the antenna aperture 114 into electrical signals that are sent to the receiver/transmitter 202. Each matching circuit may also be used to convert electrical signals sent from the receiver/transmitter 202 into electromagnetic radiation that is broadcast from the antenna aperture 114. For example, the receiver/transmitter 202 may be operated as a transmitter by sending electrical signals that encode data to the matching circuit 1. The matching circuit 1 receives the electrical signals and the matching circuit 1 and antenna aperture 114 together convert the electrical signals into electromagnetic radiation that encodes the same data and is broadcast from the antenna aperture 114 with a particular frequency. On the other hand, data encoded in electromagnetic radiation with a particular frequency broadcast from a different source interacts with the antenna aperture 114. One or more of the matching circuits may be used to convert the electromagnetic radiation into an electrical signal that is sent to the receiver/transmitter 202. The electrical signal encodes the same data as the electromagnetic wave.

Implementations are not intended to be limited to all of the matching circuits being connected to and operated by a single receiver/transmitter 202. In other implementations, each matching circuit may be connected to a separate corresponding receiver/transmitter. Alternatively, groups of matching circuits may be connected to different receiver/transmitters. For example, matching circuits 1, 3, and 5 may be connected to and operated by a first receiver/transmitter and matching circuits 2, 4, and 6 may be connected to and operated by a second receiver/transmitter.

Figure 3:
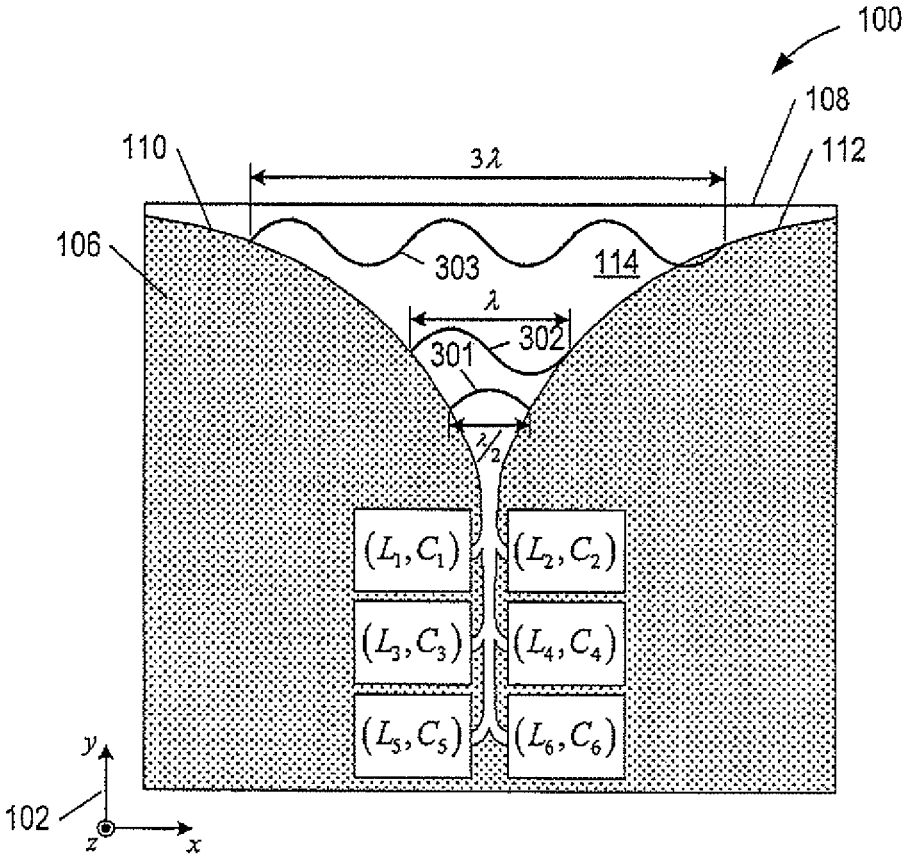
FIG. 3 shows examples of different inductance and capacitance for each of the matching circuits of the broadband antenna shown in FIG. 1A.

Each matching circuit of a broadband antenna is configured with a particular inductance, L, and capacitance, C. FIG. 3 shows examples of different inductance and capacitance for each of the matching circuits 1-6 shown in FIG. 1A. The inductance and capacitance associated with each matching circuit are denoted by ($L_m$, $C_m$), where m is a positive integer matching circuit index. For example, matching circuit 1 in FIG. 1A has corresponding inductance and capacitance denoted by ($L_1$, $C_1$) in FIG. 3. The inductance and capacitance of each matching circuit are selected to interact with frequencies of electromagnetic radiation according to a radiation condition:

$$Z_m = R_m + jX_m \tag{1}$$

where j is the imaginary unit $\sqrt{-1}$;

$R_m$ is the resistance of matching circuit m; and $X_m$ is the reactance of matching circuit m.

The reactance $X_m$ for the matching circuit m is given by:

$$X_m = \omega L_m - \frac{1}{\omega C_m} \tag{2}$$

where $\omega = 2\pi f$ is angular frequency.

Electromagnetic radiation over a continuum of frequencies may interact with the antenna aperture 114. Each frequency that interacts with the antenna aperture 114 creates corresponding standing electromagnetic waves that span various distances between the curved edges 110 and 112 within the antenna aperture 114. Any standing electromagnetic wave formed between the curved edges 110 and 112 satisfies the following condition:

$$D = \frac{\lambda p}{2} \tag{3}$$

where D is a distance between opposing edges of the antenna aperture;

$\lambda$ is the wavelength of the electromagnetic wave; and p is a positive integer.

FIG. 3 shows three examples of standing electromagnetic waves represented by sinusoidal curves 301-303 within the antenna aperture 114 of the antenna 100. Each standing electromagnetic wave has two nodes located at the edges 110 and 112. Standing wave 301 corresponds to the case where p equals 1; standing wave 302 corresponds to the case where p equals 2; and standing wave 303 corresponds to the case where p equals 6. The standing waves 301-303 represent just three of any number of standing waves that may be formed within the antenna aperture 114 when electromagnetic radiation with the wavelength $\lambda$ interacts with the antenna aperture 114.

The wavelength $\lambda$ of a standing electromagnetic wave in the antenna aperture 114 is related to the frequency f of the electromagnetic radiation as follows:

$$\lambda = \frac{v}{f} = \frac{c}{nf} \approx \frac{c}{\sqrt{\epsilon_r} f} \tag{4}$$

where v is the velocity of electromagnetic radiation in the dielectric plate 108;

c is the speed of electromagnetic radiation in a vacuum;

n is the refractive index of the dielectric plate 108; and $\epsilon_r$ is the permittivity (i.e., dielectric constant) of the dielectric plate 108.

Figure 4:
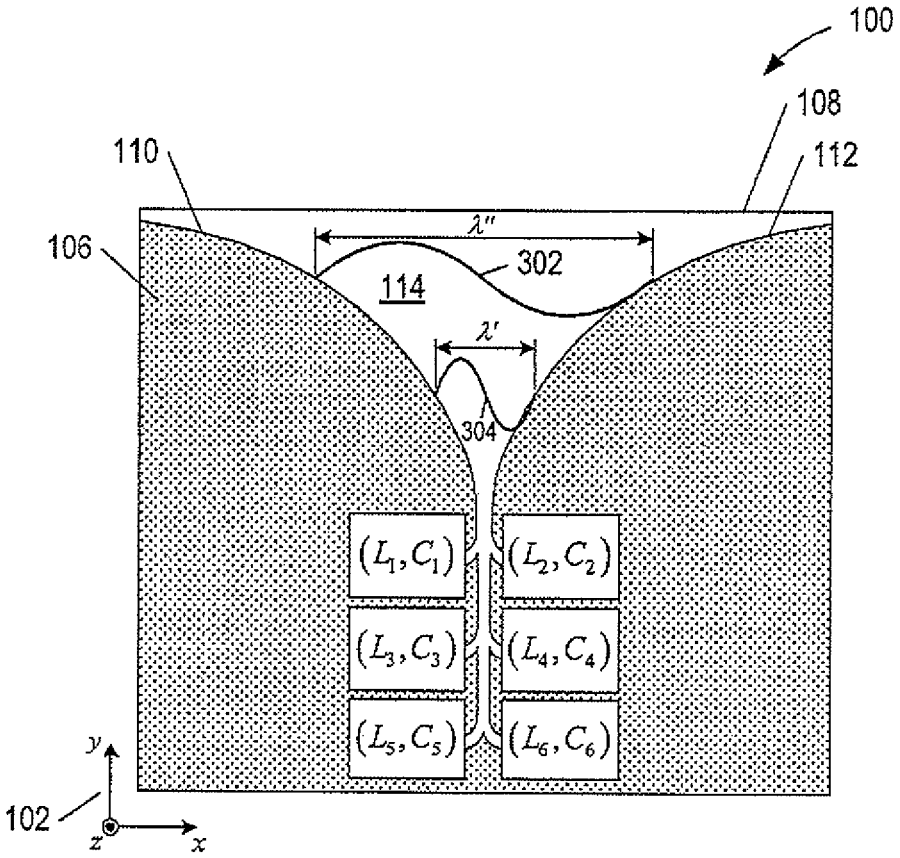
FIG. 4 shows two examples of standing electromagnetic waves within an antenna aperture of the broadband antenna shown in FIG. 1A.

FIG. 4 shows two examples of standing electromagnetic waves with different resonant wavelengths in the antenna aperture 114. Sinusoidal curve 402 represents a standing electromagnetic wave with a wavelength $\lambda''$, and sinusoidal curve 404 represents a standing electromagnetic wave with a different wavelength $\lambda'$ (i.e., $\lambda' \neq \lambda''$). The standing electromagnetic waves 402 and 404 have nodes at the two conductive curved edges 110 and 112. According to Equation (4), the standing waves 402 and 404 have corresponding frequencies $f'' \approx c/\sqrt{\epsilon_r}\lambda''$ and $f' \approx c/\sqrt{\epsilon_r}\lambda'$.

In order for electromagnetic radiation of a particular frequency resonating within the antenna aperture 114 to be converted into electrical signals by a matching circuit m, or for electrical signals sent from a transmitter to the matching circuit m to be converted into electromagnetic radiation broadcast from the antenna aperture, the reactance $X_m$ is equal to zero in the radiation condition $Z_m$. In other words, the reactance $X_m$ equal to zero represents the case where energy is not stored in the matching circuit m. As a result, the energy is either converted into an electrical signal that is sent to a receiver or the energy is converted into electromagnetic radiation that is broadcast via the antenna aperture. On the other hand, when the reactance $X_m$ for a matching circuit is not equal zero the energy associated with an electrical signal sent to the matching circuit m is stored and converted into thermal energy, or electromagnetic radiation that enters the matching circuit m is stored and converted into thermal energy. Consider, for example, electromagnetic radiation with a frequency f" resonating in the antenna aperture 114 and a matching circuit m with a reactance given by $$X_m = 2\pi f'' L_m - \frac{1}{2\pi f'' C_m} \neq 0 \tag{5}$$

In other words, the matching circuit m stores the energy of the electromagnetic radiation with frequency f" because $$f'' \neq \frac{1}{2\pi\sqrt{L_m C_m}} \tag{6}$$

On the other hand, consider electromagnetic radiation with a frequency f' resonating in the antenna aperture 114 and the matching circuit m has a reactance given by:

$$X_m = 2\pi f' L_m - \frac{1}{2\pi f' C_m} = 0 \tag{7}$$

Solving for the frequency f' gives:

$$f' = \frac{1}{2\pi\sqrt{L_m C_m}} \tag{8}$$

In this case, the energy of the electromagnetic radiation with the frequency f' is not stored in that matching circuit m but is instead converted into an electrical signal by the matching circuit m that is transmitted to a receiver. Alternatively, an electrical signal sent to the matching circuit m may be broadcast from the antenna with the frequency f'. The frequency f' and a range of frequencies centered around the frequency f' that substantially satisfy Equation (8) is referred to as the frequency band of the matching circuit m and the energy associated with the frequency band is not stored in the matching circuit m.

The broadband antennas described herein include two or more matching circuits that are each configured with a different inductance and capacitance. Even though each matching circuit may have an associated frequency band, the frequency bands of the matching circuits are different such that a frequency band of one matching circuit is not a frequency band of the other matching circuits. As a result, different matching circuits may be used to receive and convert electromagnetic radiation resonating with different frequencies resonating in the antenna aperture into an electrical signal and each matching circuit may be used to broadcast electromagnetic energy with a different frequency.

Figure 5:
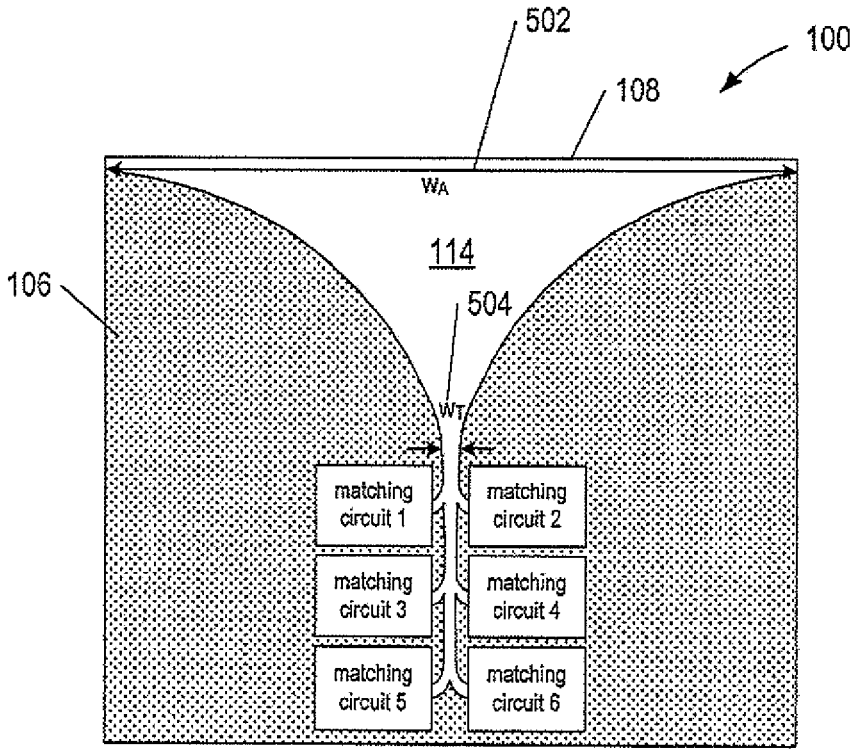
FIG. 5 shows a broadband antenna with an antenna aperture mouth and throat dimensions identified.

The aperture width and throat width determine the overall bandwidth of a notch antenna. The lowest frequency, $f_{low}$, of electromagnetic radiation that may interact with the antenna aperture 114 resonates near the largest aperture width $w_A$, and the highest frequency, $f_{high}$, of electromagnetic radiation that may interact with the antenna aperture 114 resonates near the shortest aperture width $w_T$. FIG. 5 shows the largest aperture width $w_A$ 502 occurs at the mouth of the antenna aperture 114 and the shortest aperture width $w_T$ 504 occurs in the throat 116. In other words, the largest aperture width $w_A$ and the shortest aperture width $w_T$ determine the absolute bandwidth of the antenna given by:

$$\Delta f = f_{high} - f_{low} \tag{9}$$

Another way of characterizing the frequency bandwidth above the lowest frequency $f_{low}$ is a bandwidth ratio given by:

$$BW_{ratio} = \frac{f_{high}}{f_{low}} \geq \Delta f \tag{10}$$

where $\Delta f \geq 2$.

For example, antenna 100 may be configured as an ultra-broadband antenna with the largest aperture width $w_A$ and the shortest aperture width $w_T$ selected so that the highest frequency $f_{high}$ that may interact with the antenna 100 is at least 500% (i.e., $\Delta f=5$ times) greater than the lowest frequency $f_{low}$ that may interact with the antenna 100. Suppose the bandwidth $\Delta f$, highest frequency $f_{high}$, and the lowest frequency $f_{low}$ have been selected for an antenna. The lowest frequency $f_{low}$ corresponds to a wavelength where half the wavelength equals the largest aperture width $w_A$. In other words, $\Delta_{low}=c/\sqrt{\epsilon_r} f_{low}$ and $w_A=\lambda_{low}/2$. Using Equation (3) with p equal to 2 and Equation (4), the largest width of the antenna aperture may be determined by $$w_A = \frac{c}{2\sqrt{\epsilon_r}\, f_{low}} \tag{11}$$

and the shortest width of the antenna aperture may be determined by $$w_T = \frac{c}{2\sqrt{\epsilon_r}\, f_{high}} \tag{12}$$

The frequency bandwidth ratio of the antenna 100 may be determine according to $$BW_{ratio} = \frac{f_{high}}{f_{low}} = \frac{w_A}{w_T} \tag{13}$$

The antenna aperture 114 may be used to generate electromagnetic radiation and receive electromagnetic radiation in a broadband of the radio spectrum of the electromagnetic spectrum. The antenna aperture 114 may be used to send and receive electromagnetic radiation in the Very High (i.e., about 30 MHz to about 300 MHz), Ultra High (i.e., about 300 MHz to about 3 GHz), and/or the Super High (i.e., about 3 GHz to about 300 GHz) frequency bands of the radio spectrum. For example, the antenna 100 may be configured to interact with a frequency range that spans portions of the Very High and Ultra High frequency ranges with $f_{low}$=200 MHz and $f_{high}$=2.0 GHz. The antenna 100 would have a bandwidth of 1.8 GHz and a bandwidth ratio of 10. In other words, the antenna is considered an ultra-broadband antenna with highest frequency 2.0 GHz, which is 1,000% greater than the lowest frequency of 200 MHz. Depending on the dielectric material selected for the dielectric plate 108, the width of the opening of the antenna aperture 114 and the throat 116 are calculated as follows:

$$w_A = \frac{c}{2\sqrt{\epsilon_r}\,200\text{ MHz}}$$

$$w_T = \frac{c}{2\sqrt{\epsilon_r}\,2.0\text{ GHz}}$$

Figure 6:
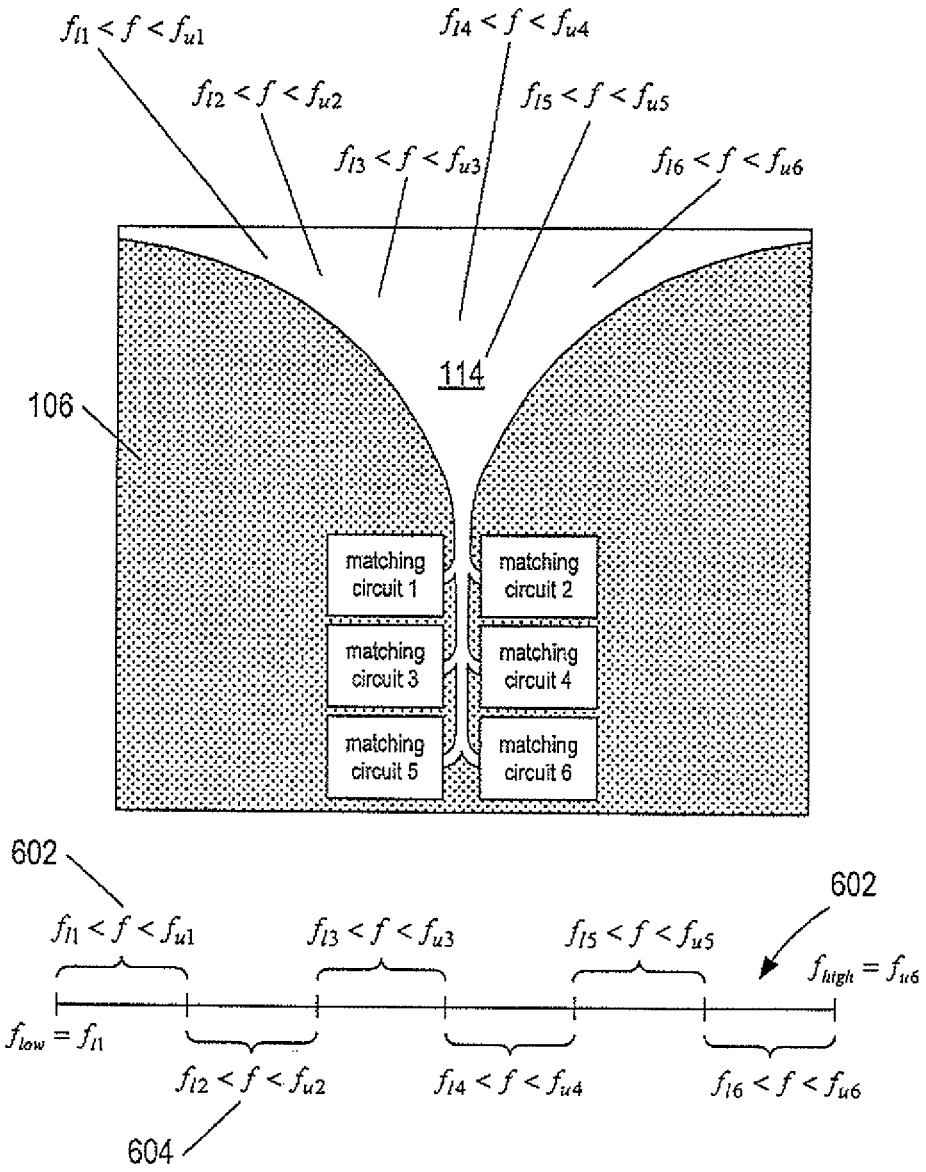
FIG. 6 shows an example of different frequency bands associated with six different matching circuits of a broadband antenna.

As described above, the inductance and capacitance of each matching circuit may be selected to interact with different frequency bands of the overall frequency bandwidth Δf of the antenna aperture. FIG. 6 shows an example of six different frequency bands associated with the six different matching circuits 1-6. Each frequency band is represented by an interval denoted by $f_{lm}<f<f_{um}$, where m is the matching circuit index equal to 1, 2, 3, 4, 5, and 6, $f_{lm}$ represents the lower bound of the frequency band, and $f_{um}$ represents the upper bound of the frequency band. Each matching circuit may be used to broadcast and receive electromagnetic radiation in an associated frequency band, provided the frequencies substantially satisfy the condition in Equation (8) above. For example, matching circuit 1 may be used to broadcast and receive electromagnetic radiation in the frequency band $f_{l1}<f<f_{u1}$ provided $X_1(f)\approx 0$. The frequency bands may be selected to cover the broadband frequency bandwidth Δf of the antenna 100. FIG. 6 shows a line 602 that represents the range of frequencies between $f_{high}$ and $f_{low}$ of antenna aperture 114. In this example, the frequency bands associated with matching circuits 1-6 cover the entire bandwidth between $f_{high}$ and $f_{low}$, where $f_{low}=f_{l1}$ and $f_{high}=f_{u6}$.

Figure 7:
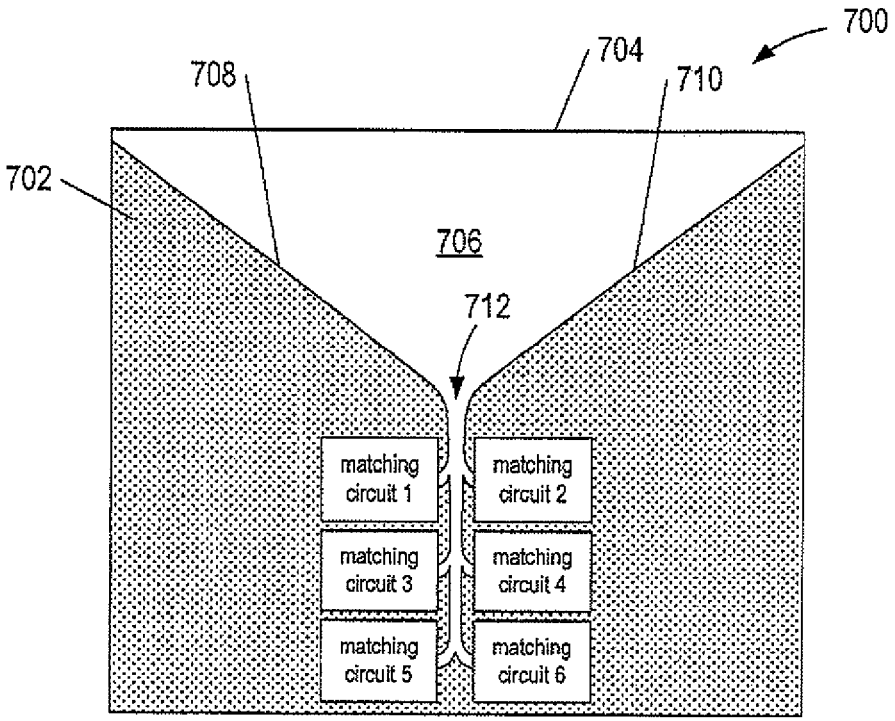
FIG. 7 shows an example broadband notch antenna with a V-shaped antenna aperture.

Broadband antennas are not limited to trumpet-shaped antenna apertures. In other implementations, notch antennas may be configured with V-shaped antenna apertures. FIG. 7 shows an example broadband notch antenna 700 with a V-shaped antenna aperture. The antenna 700 is similar to the antenna 100. The antenna 700 includes a conductive layer 702 disposed on a first surface of a dielectric plate 704. The conductive layer 702 is formed with a V-shaped notched region 706 that exposes a portion of the dielectric plate 704 between two straight edges 708 and 710 of the conductive layer 702. The notched region 706 is a V-shaped antenna aperture that narrows to form a throat 712 with six branching channels that lead to six matching circuits as described above.

Figure 8:
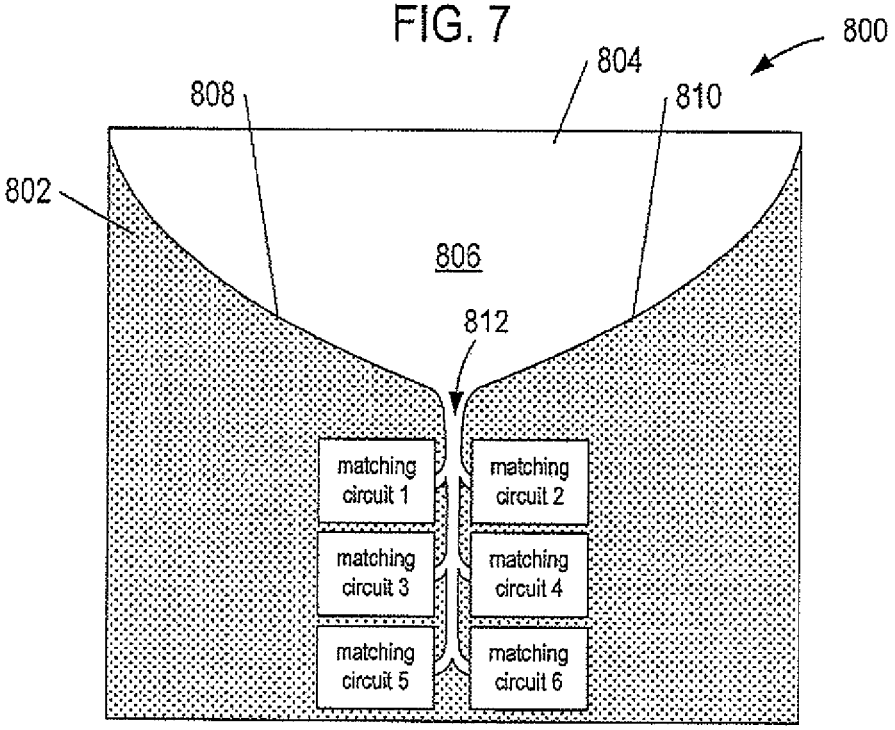
FIG. 8 shows an example broadband notch antenna with a semicircular-shaped antenna aperture.

In still other implementations, notch antennas may be configured with dome-shaped antenna apertures. FIG. 8 shows an example broadband notch antenna 800 with a semicircular-shaped antenna aperture. The antenna 800 is similar to the antenna 100. The antenna 700 includes a conductive layer 802 disposed on a first surface of a dielectric plate 804. The conductive layer 802 is formed with a semicircular-shaped notched region 806 of the dielectric plate 804 between two curved edges 808 and 810 of the conductive layer 802. The notched region 806 is a semicircular-shaped antenna aperture that leads to a throat 812 with six matching circuits as described above.

Figure 9A:
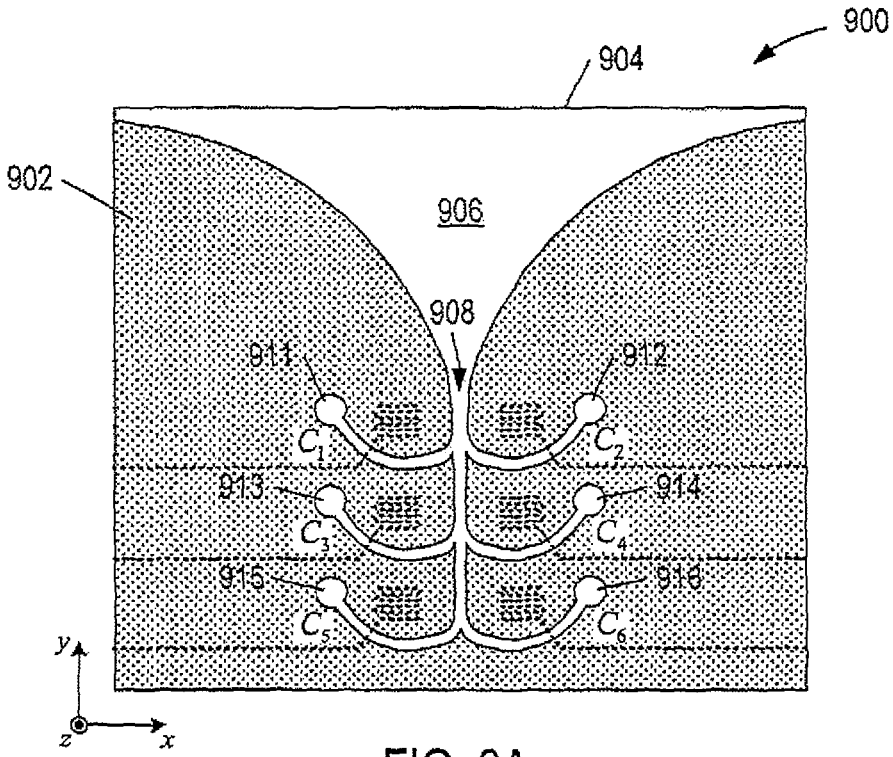
FIGS. 9A and 9B show an example implementation of six matching circuits of a broadband antenna.
Figure 9B:
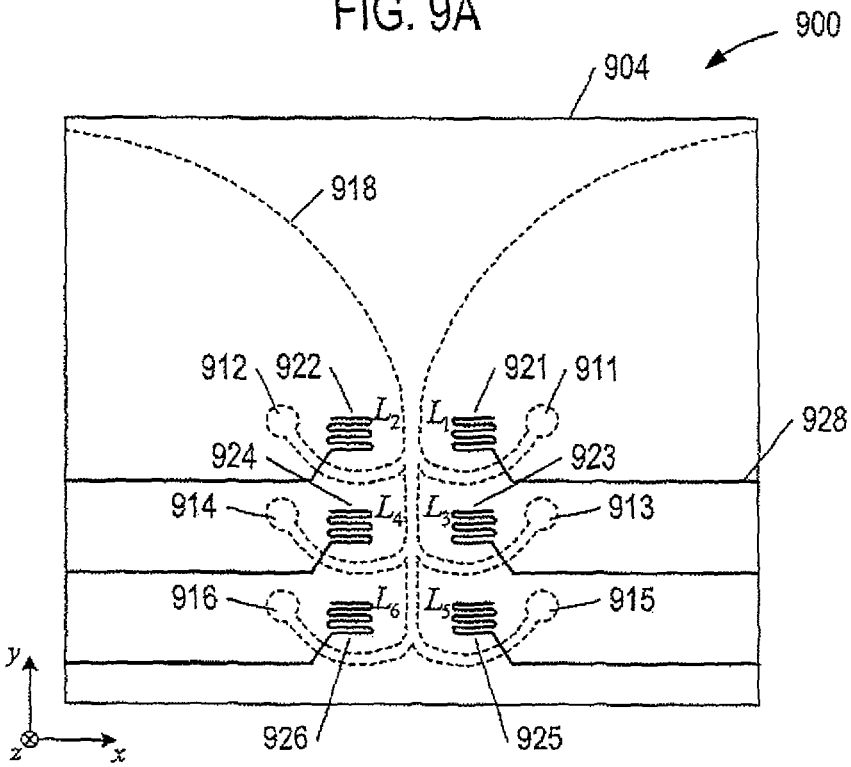

FIGS. 9A and 9B show an example implementation of six matching circuits 901-906 of a broadband antenna 900. FIG. 9A shows an xy-plane view of a first surface of the antenna 900 and FIG. 9B shows an xy-plane view of a second opposite surface of the antenna 900. The antenna 900 includes a conductive layer 902 disposed on a first surface of a dielectric plate 904. The conductive layer 902 includes an antenna aperture 906 and a throat 908 configured in the same manner as the antenna aperture 114 and throat 116 of the antenna 100 described above. As shown in FIG. 9A, the conductive layer 902 is formed so that the throat 908 branches into six channels that terminate with open circle-shaped regions 911-916. The circle-shaped regions 911-916 and the channels that lead to the circle-shaped regions form the capacitors labeled $C_m$ as described above with reference to FIG. 3. FIG. 9B shows an opposite second surface of the antenna 900 shown in FIG. 9A. Edges of the conductive layer 902 are represented by dashed line 918. Serpentine meander lines 921-926, shown as dashed lines in FIG. 9A, are inductors printed on the second surface of the dielectric plate 904. The inductors 921-926 are labeled $L_m$ as described above with reference to FIG. 3. Each inductor is connected to a feed line, such as feed line 928, the leads from inductor 921 to the edge of the dielectric plate 904 and may be connected to a receiver/transmitter as described above with reference to FIG. 2. Note that each inductor does not overlap a capacitor or a channel formed in the conductive layer 902 and that each feed printed on the second surface of the dielectric plate 904 crosses a channel formed in the conductive layer 602 disposed on the first surface as approximately 90 degrees. In this example, pairs of meander-line inductors and circular capacitors form the six matching circuits. For example, circular capacitor 911 and meander-line inductor 921 form a matching circuit and circular capacitor 916 and meander-line inductor 926 form a matching circuit.

Figure 10A:
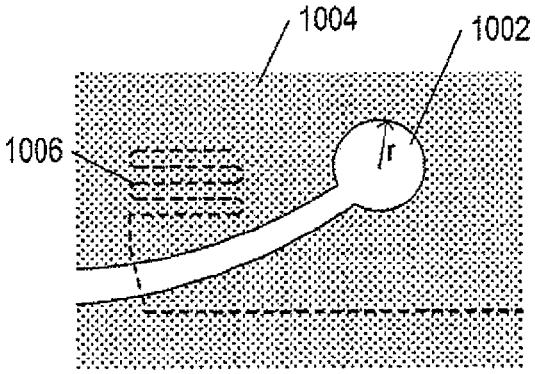
FIGS. 10A-10F show various example configurations of inductors and capacitors for matching circuits.
Figure 10D:
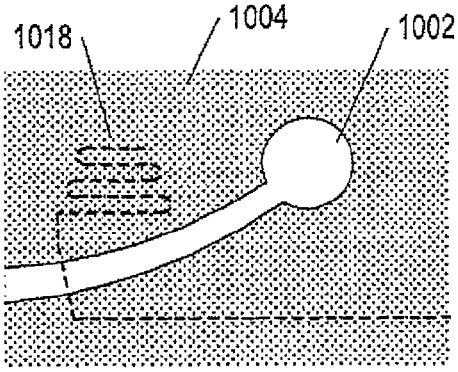
Figure 10B:
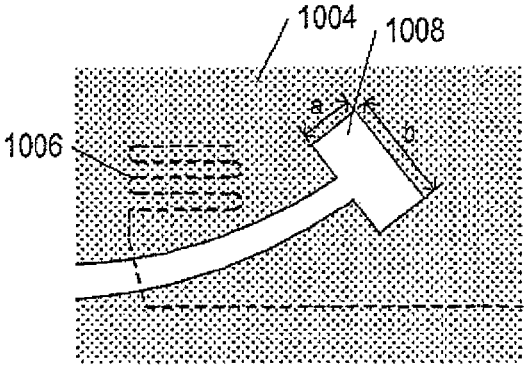
Figure 10E:
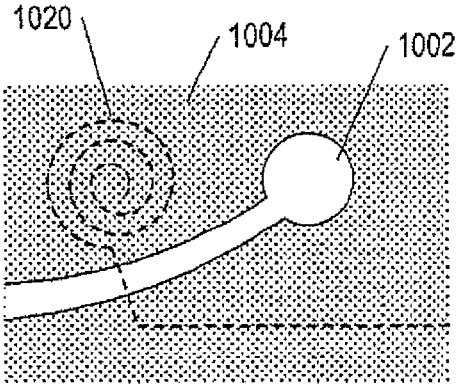
Figure 10C:
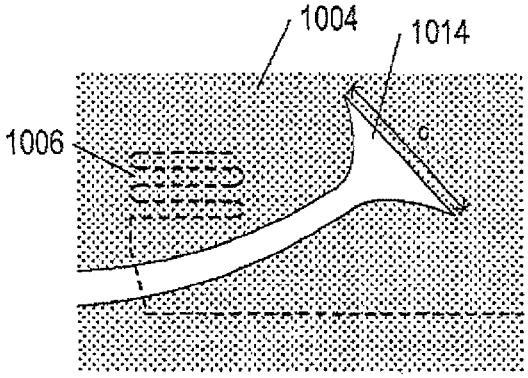
Figure 10F:
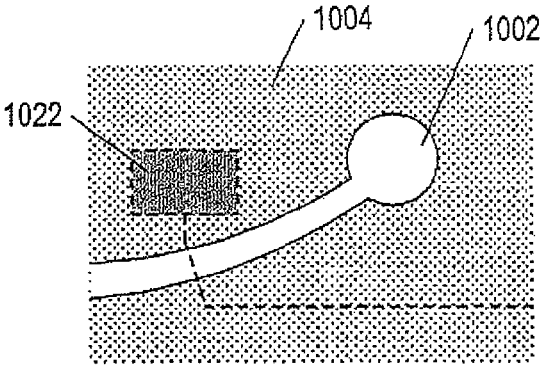

FIGS. 10A-10C shows three examples of matching circuits with the same inductor but different capacitors that may be formed in the conductive layer. FIG. 10A shows a matching circuit composed of a circular capacitor 1002 with radius r formed in a conductive layer 1004 disposed on a surface of a dielectric plate and serpentine dashed line 1006 represents a meander-line inductor printed on the opposite surface of the dielectric plate, as described above with reference to FIGS. 9A-9B. FIG. 10B shows a matching circuit composed of a rectangular capacitor 1008 with width a and height b formed in a conductive layer 1010 disposed on a surface of a dielectric plate and a meander-line inductor 1006 printed on the opposite surface of the dielectric plate. FIG. 10C shows a matching circuit composed of a trumpet-shaped capacitor 1014 with mouth length c formed in a conductive layer 1016 disposed on a surface of a dielectric plate and a meander-line inductor 1006 printed on the opposite surface of the dielectric plate. The capacitance of the example capacitors 1002, 1008, and 1014 may be changed by varying the width of the channels and/or size of the dimension parameters: r, a and b, and c. For example, the capacitance of the capacitor 1008 may be changed by varying the dimensions of a and b. Other capacitor shapes not shown include, arrowhead shapes, elliptical shapes, oval shapes, or channels that simply terminate with no addition features formed at the ends of the channels (i.e., the channels alone may be used as capacitors with varying length and width). FIGS. 10D-10F shows three examples of matching circuits with the same circular capacitor 1002 formed in the conductor 1004 but different inductors that may be printed on the surface of the dielectric plate opposite the conductive layer 1004. FIG. 10D shows a tapered meander line inductor 1018; FIG. 10E shows a spiral-shaped meander line inductor 1020; and FIG. 10F shows a conductive patch 1022. The conductive path may also be circular shaped or square shaped.

Implementations described above are not intended to be limited to the descriptions above. For example, the lengths of the meander line inductors and surface area and shape of the inductive patch may be varied to achieve a desired inductance. Matching circuits are also limited to the example inductor and capacitor pairings shown in FIGS. 10A-10F. For example, a matching circuit may be formed the spiral inductor 1020 and the rectangular capacitor 1008.

It is appreciated that the previous description of the disclosed embodiments is provided to enable a person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. An antenna comprising:

a planar dielectric plate;

a conductive layer disposed on a surface of the dielectric plate, the conductive layer having an antenna aperture and a throat formed between edges of the conductive layer; and two or more frequency matching circuits that branch from the throat, each frequency matching circuit formed on opposite surfaces of the dielectric plate to send and receive electromagnetic radiation in a frequency band of a radio spectrum, wherein each frequency matching circuit includes a capacitor and an inductor, the capacitor is an opening in the conductive layer located at the end of a channel that branches from the notched region and the inductor is disposed on the second surface not opposite the channel or the capacitor.

2. The antenna of claim 1, wherein the antenna aperture tapers to the throat, two or more channels that branch from the throat, each channel leads to one of the two or more frequency matching circuits.

3. The antenna of claim 1, wherein the antenna aperture is trumpet shaped, V-shaped, or semicircular shaped.

4. The antenna of claim 1, wherein capacitance and inductance of the capacitors and inductors of the frequency matching circuits are different.

5. The antenna of claim 1, wherein each capacitor further comprises a shape of one of circular, square, rectangle, trumpet, elliptical, and oval.

6. The antenna of claim 1, wherein each inductor is connected to a feed line disposed on the second surface.

7. The antenna of claim 1, wherein each inductor further comprises one of a serpentine shape, a tapered serpentine shape, a spiral, a square patch, a circular patch, and a rectangular patch.

8. The antenna of claim 1, wherein the antenna aperture further comprises a largest width that corresponds to a low radio frequency and a shortest width that corresponds to a high radio frequency such that a ratio of the high radio frequency to the low radio frequency is greater than or equal to 3.

* * * * *